US006543434B2

(12) United States Patent
Holzmuller et al.

(10) Patent No.: US 6,543,434 B2
(45) Date of Patent: Apr. 8, 2003

(54) DEVICE FOR SIMULTANEOUSLY SEPARATING A MULTIPLICITY OF WAFERS FROM A WORKPIECE

(75) Inventors: Bernhard Holzmuller, Börwang (DE); Ulrich Wiese, Burghausen (DE); Jochen Greim, Burghausen (DE)

(73) Assignee: Wacker-Chemie GmbH, Müchen (DE)

( * ) Notice: Subject to any disclaimer, the term of this patent is extended or adjusted under 35 U.S.C. 154(b) by 51 days.

(21) Appl. No.: 09/730,086

(22) Filed: Dec. 5, 2000

(65) Prior Publication Data

US 2001/0004891 A1 Jun. 28, 2001

(30) Foreign Application Priority Data

Dec. 9, 1999 (DE) ..... 199 59 414

(51) Int. Cl.[7] ..... B28D 1/08

(52) U.S. Cl. ..... 125/21; 125/12; 125/16.01; 125/16.02; 125/19

(58) Field of Search ..... 125/12, 16.01, 125/16.02, 19, 21

(56) References Cited

U.S. PATENT DOCUMENTS 4,727,852 A 3/1988 Schmid et al.
5,564,409 A * 10/1996 Bonzo et al. ..... 125/12
6,024,080 A * 2/2000 Hodsen ..... 125/21
6,065,462 A * 5/2000 Hodsen et al. ..... 125/21
6,237,585 B1 * 5/2001 Oishi et al. ..... 125/16.02

FOREIGN PATENT DOCUMENTS

DE 198 41 492 3/2000
DE 198 51 070 5/2000

OTHER PUBLICATIONS

U.S. specification corresponding to DE 198 51 070 (Application Ser. No. 09/434,582) and Abstract.
U.S. specification corresponding to DE 198 41 492 (Application Ser. No. 09/387,454) and Abstract.

* cited by examiner

*Primary Examiner*—Joseph J. Hail, III
*Assistant Examiner*—Shantese McDonald
(74) *Attorney, Agent, or Firm*—Collard & Roe, P.C.

(57) ABSTRACT

A device for simultaneously separating a multiplicity of wafers from a hard brittle workpiece having a longitudinal axis, with a wire web made from saw wire and with an advancing device which brings about a translational relative movement, which is perpendicular to the longitudinal axis of the workpiece, between the workpiece and the wire web of the wire saw, in the course of which movement the workpiece is passed through the wire web, wherein the wire web is formed from a multiplicity of individual wires, and wherein there is a device for holding and rotating the workpiece about the longitudinal axis.

14 Claims, 5 Drawing Sheets

DEVICE FOR SIMULTANEOUSLY SEPARATING A MULTIPLICITY OF WAFERS FROM A WORKPIECE

BACKGROUND OF THE INVENTION

The invention relates to a device for simultaneously separating a multiplicity of wafers from a hard brittle workpiece and to an associated method.

To separate wafers from a hard brittle workpiece, wire saws are known which operate with a sawing slurry (cutting lapping) and others in which abrasive grains are securely bonded to the saw wires (abrasive cutting). As an alternative to saw wires, saw bands and parting blades are also used as tools.

Abrasive cutting using diamond-studded saw wires is used predominantly for making individual cuts. It is possible to distinguish between installations which operate with a coiled, open-ended individual wire and those which operate with an endless wire turning at high speed. With these methods, simultaneous multiple cuts are not possible.

Diamond wire sawing using a multiply coiled, finite individual wire is described in application DE 19851070, which has not yet been laid open for inspection. This application describes a method and a device for simultaneously separating a multiplicity of wafers from a hard brittle workpiece, the workpiece being passed through the wire web formed by a saw wire by a translational relative movement, perpendicular to the longitudinal axis, between the workpiece and a wire web of a wire saw, with the aid of an advancing device. In this invention, the workpiece is rotated about the longitudinal axis while the wafers are being separated.

Despite a large number of advantages, this method also has specific disadvantages:

- A precondition for the device to function correctly is that a separate wire-guidance system be present, which is formed from at least two reels for coiling and uncoiling the wires and a plurality of tensioning and guide rolls. Owing to the abrasive grains which are securely bonded to the saw wire, the diamond saw wire is very brittle and of low elastic deformability, making coiling and uncoiling difficult.
- Owing to their low elasticity, their high brittleness and high mechanical stress concentration, the diamond saw wires are highly sensitive. This mechanical sensitivity promotes damage and cracks in the wires at tensioning and guide rolls.
- Wire lengths of several kilometers are required. In the prior art, availability of such lengths in sufficient quantities and quality does not exist or is very restricted.

A reciprocating multiple wire saw with diamond-tipped tool is described in U.S. Pat. No. 4,727,852. In this fixed abrasive slicing technique (FAST technique), the longitudinally oriented saw wires are tensioned in a frame which executes a translational, oscillating movement through the workpiece, which is itself rocking about an axis oriented perpendicular to the wires, so that the short contact length between saw wire and workpiece is intended to ensure an acceptable separating rate.

BRIEF DESCRIPTION OF THE INVENTION

The object of the present invention is to provide a device which provides an improved sawing method for simultaneously separating a multiplicity of wafers from a hard brittle workpiece having a longitudinal axis.

This object is achieved by a device with a wire web made from saw wire and with an advancing device which brings about a translational relative movement, which is perpendicular to the longitudinal axis of the workpiece, between the workpiece and the wire web of the wire saw, in the course of which movement the workpiece is passed through the wire web, wherein the wire web is formed from a multiplicity of individual wires, and wherein there is a device for holding and rotating the workpiece about the longitudinal axis.

DETAILED DESCRIPTION OF THE INVENTION

Figure 1A:
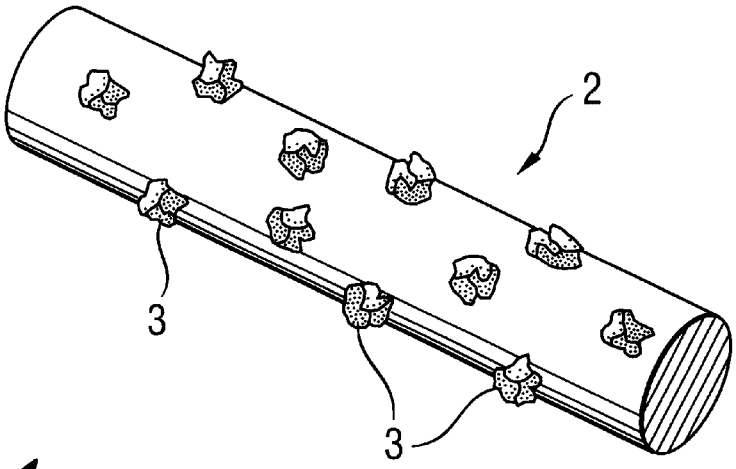
FIG. 1A is an enlarged view of area LA of FIG. 1.

In the context of the invention, a longitudinal axis of the workpiece is to be understood as meaning the geometric center of the workpiece. The workpiece extends rotationally symmetrically about this axis.

The device according to the invention may be designed either for operation with a slurry or for operation with saw wire which is covered with abrasive grain, for example diamond. The device according to the invention is preferably designed for operation with saw wire which is covered with abrasive grain, for example diamond.

The saw wires used are preferably open-ended diamond saw wires. They preferably have a core diameter of approx. 100 $\mu$m to 800 $\mu$m and a diamond grain size of from 15 $\mu$m to 150 $\mu$m. In principle, the use of a saw wire which comprises CBN (cubic boron nitride) or SiC as the abrasive grain is also possible.

The cross section of the saw wire may be circular or of any other desired shape. It is preferable to use saw wire with a length which corresponds to the distance between the saw heads.

The wires are preferably combined to form a linear web in which the wires are at a defined spacing and are under a defined tension. The spacing and tension are determined by the particular processing task.

For example, to produce ceramic substrates for magnetic storage disks, the wire spacing is preferably approx. 0.7 to 1.5 mm and the wire loading is preferably up to 1000 g/wire, and the tangential wire speed is preferably 1 to 3 m/s.

According to the invention, the wire web is preferably a linear web comprising individual wires. The linear web preferably corresponds to the web used in the FAST technique which is known from U.S. Pat. No. 4,727,852, and consequently U.S. Pat. No. 4,727,852 is hereby incorporated by reference.

With regard to the device for holding and rotating the workpiece, reference is made to German application DE 19851070, in particular the figures and the explanation of the figures in the description, and DE 19851070 is hereby incorporated by reference.

Compared to a multiply coiled wire web, the use of a saw web composed of a multiplicity of individual wires has the following significant advantages:

- Due to the shorter wire length, the production of short diamond saw wires can be controlled more reliably for process technology reasons. A saw web composed of individual wires is thus easy to obtain in a high quality.
- Due to the shorter length, the saw wires may have a smaller diameter and can be of any desired cross section.
- Fewer wire-guidance and tensioning rolls are required in the sawing device, and consequently there is a reduced risk of damage to the wires and wires fracturing during sawing.
- Simpler machine designs can be used. In particular, it is possible to save on complex wire-guidance and laying units.

The invention also relates to a method for simultaneously separating a multiplicity of wafers from a hard brittle workpiece, wherein the separating is carried out by means of a device according to the invention.

In the method according to the invention, the workpiece, which has a longitudinal axis, is passed through the wire web by means of a translational relative movement, which is perpendicular to the longitudinal axis of the workpiece, between the workpiece and the wire web comprising a multiplicity of individual wires, with the aid of an advancing device, and is divided into wafers as it penetrates through the wire web, the workpiece being rotated about its longitudinal axis as the wafers are being separated.

The method according to the invention significantly increases the sawing capacity. For example, compared to the circular sawing incision during sawing, the sawing capacity increases, since an advancement travel corresponding to half the diameter in the case of solid cylinders or the wall thickness in the case of hollow cylinders is sufficient to completely separate the wafer. At the same time, there is a short, constant engagement length of the tool with uninterrupted engagement over the entire length of the cut. This is advantageous, since it ensures a steady-state process and a steady-state tool performance. It is possible to achieve shorter sawing times by specifically selecting the engagement length of the saw wire and the advancement speed. It is possible to dispense with the operation of fitting a saw strip before separation and detaching the residual saw strip after separation when separating semiconductor wafers.

Compared to known methods in which a slurry is used, the method according to the invention also offers advantages when a slurry is used. As the workpiece turns, the slurry is better distributed in the saw gap, so that an adequate supply of slurry to the saw gap is ensured. Rotating the workpiece about the longitudinal axis may also lead to punctiform contact between the saw wire and the workpiece in the cutting gap and thus to a high sawing pressure. As a result, and through a possible increase in the relative speed of the saw wire if the workpiece and saw wire rotate in opposite directions, separation of the wafers can be accelerated. Any necessary reduction in the speed of revolution of the saw wire can be compensated for by correspondingly increasing the rotational speed of the workpiece. Overall, the above-mentioned advantages make the method according to the invention more economical.

The use of a coolant in the method according to the invention (wet cutting) may take place in the process by providing for passage through a basin in which the saw wire is wetted. The entire separating operation may also be carried out entirely under coolant in a trough. Over and above the known advantages of cooling, lubrication and rinsing, this method offers the advantage that the saw wires operate without vibration. This increases the service life of the saw wires and also the process reliability. The use of a coolant when wafers are being separated from a hard brittle workpiece by means of a wire web is known, for example, from DE 19841492 (corresponds to U.S. application bearing the Ser. No. 09/387454).

Over and above the process technology advantages, there are further advantages associated with the invention. For example, the wafer yield increases due to the low gap width which is possible as a result of using small saw wire diameters, and the shape and dimensional accuracy (TTV-total thickness variation, ripples) can be improved. At the same time, the rotational cutting promotes a rotationally symmetrical form (planarity) of the workpiece. This reduces the machining outlay during subsequent manufacturing steps.

In addition to separating semiconductor wafers from a crystal, the invention is particularly suitable for separating wafers which are to be processed further to form hard disks. In contrast to crystals which are present in the form of solid bodies, wafers which are to be processed further to form hard disks are separated from workpieces which, by dint of having an axial bore, are rotationally symmetrical hollow bodies.

The workpieces preferably consist of hard brittle material, such as silicon or gallium arsenide, if they are made from semiconductor material, and of silicon carbide, if they are material for producing hard disks.

The invention provides for the workpiece to be rotated about the longitudinal axis while wafers are being separated. There are various options open to the user. For example, the direction of rotation can be maintained or can be changed periodically or according to a defined program. If the direction of rotation is changed, the workpiece may be rotated longer in one direction than in the opposite direction or may be rotated for equal lengths of time in each direction of rotation.

In the case of a workpiece which is designed as a hollow body, a support body, for example a rod made from glass, graphite, metal or plastic, which is connected in the cavity in the workpiece to the internal circumferential surface of the workpiece, is necessary in order to rotate the workpiece.

If a saw strip or another support body is being used, the separation of the wafers is carried out over a distance which is such that the saw wire of the wire web also cuts into the support body. Consequently, the separated wafers remain fixed on the remainder of the support body.

The angle through which the workpiece is rotated during separation of the wafers is preferably greater than 0° and less than 360°, if a saw strip is adhesively bonded or cemented onto the circumferential surface of the workpiece. A rotation angle of from 5° to 355° is particularly preferable. If a saw strip of this type is not being used, or if a workpiece designed as a hollow body is being divided into wafers, the rotation angle should be greater than 0°, preferably at least 5°, and may be any angle greater than this.

According to a preferred embodiment of the method, the workpiece is held by center sleeves at the beginning of separation of the wafers and by rollers at the end of separation of the wafers, the center sleeves engaging on end sides of the workpiece and the rollers engaging on the circumferential surface of the workpiece. This method is suitable for solid workpieces, such as crystals of semiconductor material.

In the case of workpieces designed as hollow bodies, the center sleeves engage on the support body which is situated in the cavity in the workpiece. They turn the support body and therefore also the workpiece about the longitudinal axis thereof.

According to a further preferred embodiment of the method, a plurality of workpieces are arranged next to one another, and the wafers are simultaneously separated from the workpieces.

The invention is explained in more detail below with reference to figures, in which only features which contribute to the explanation are shown.

Figure 1:
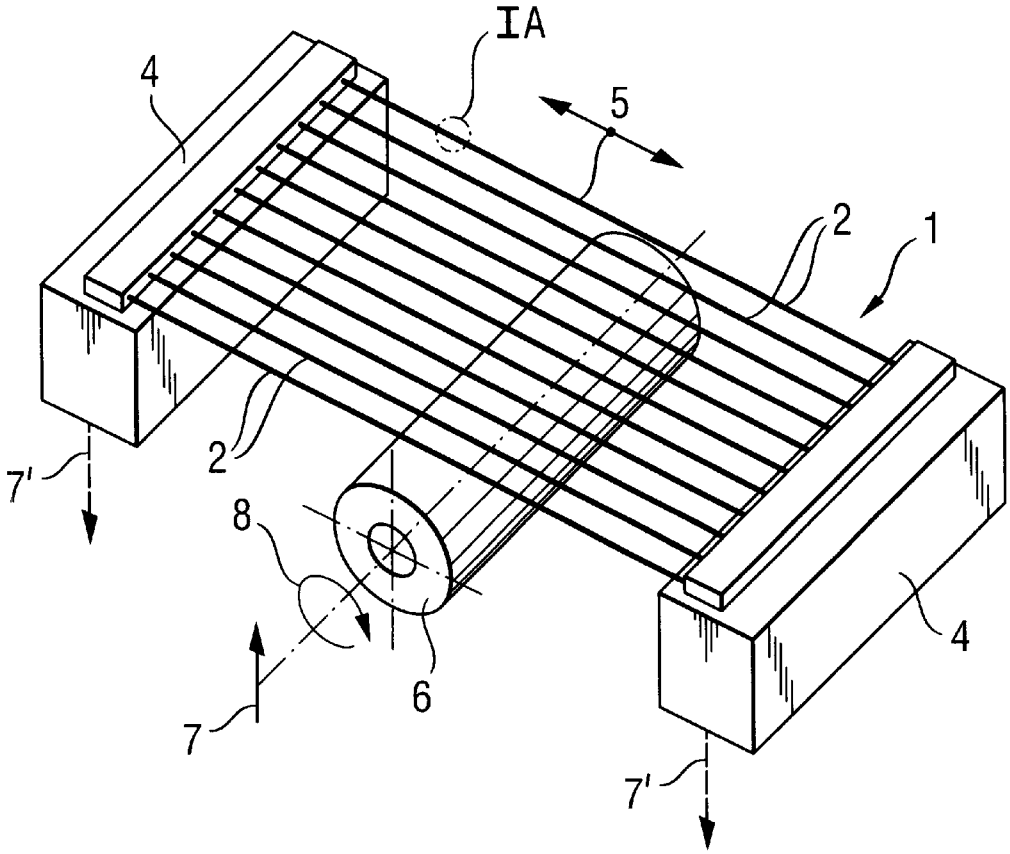
FIG. 1 is a diagrammatic illustrative view in perspective of an apparatus of the invention and a workpiece before beginning separation of wafers and a view of the wire web.

FIG. 1 shows a device according to the invention with a linear web prior to commencement of the separation of wafers from a workpiece. The linear web (1) comprises saw wires (2) in which abrasive grain (3) is securely bonded to the saw wire (2), mounted on a saw head (4). This saw device oscillates in the direction of movement indicated by the arrow (5). The workpiece (6) is passed through the wire web from below by means of a translational relative movement, which is perpendicular to the longitudinal axis of the workpiece, with the aid of an advancing unit and is divided into wafers as it passes through the wire web. Alternatively, the advancing device can be used to move the wire web toward the workpiece. The arrows (7, 7') represent the respective directions of movement. The workpiece (6) is moved about its longitudinal axis, as indicated by the arrow (8). The direction of rotation may be maintained or periodically changed or may also be adapted in any desired way to the oscillation of the saw wires. In the event of the direction of rotation being changed, the workpiece may be rotated in one direction for longer than in the opposite direction. However, it is also possible for the workpiece to be rotated for equal lengths of time in each direction.

Figure 2:
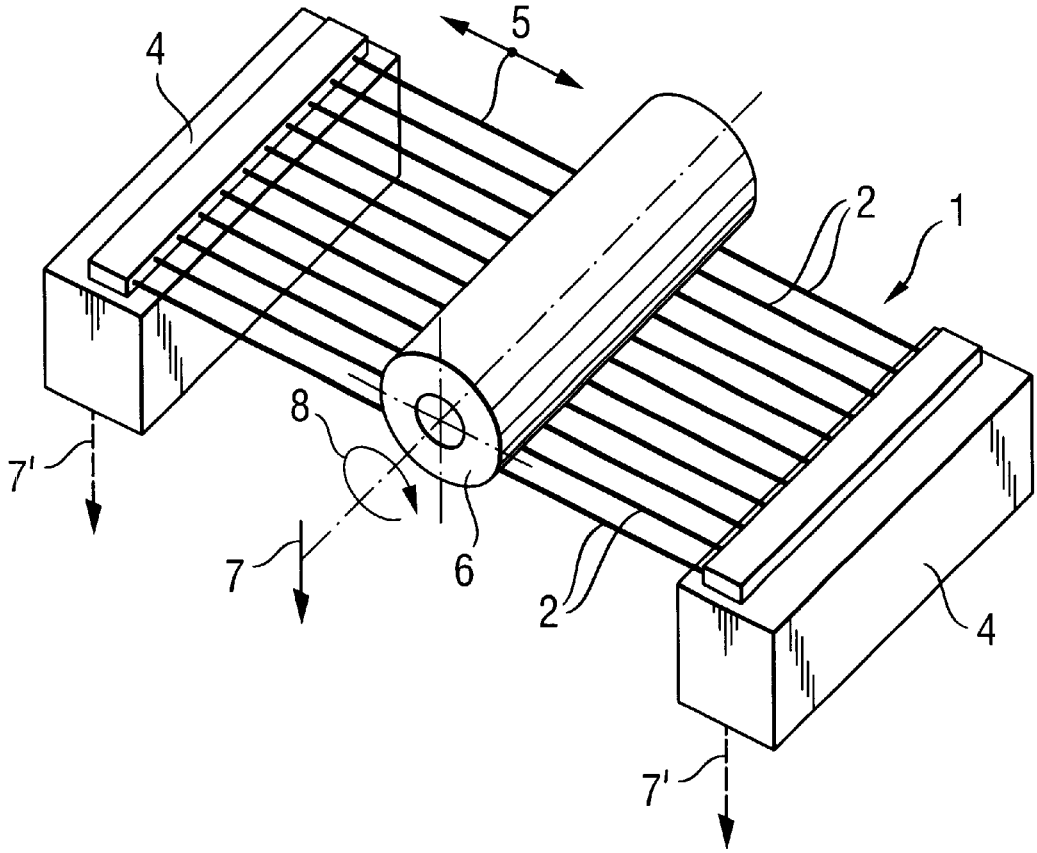
FIG. 2 is a diagrammatic illustration in perspective of an apparatus of the invention in which the workpiece has partially passed through the wire web in a downward direction.

FIG. 2 shows the device according to the invention as shown in FIG. 1, with the difference that the workpiece (6) is passed through the linear web from above by means of a translational relative movement, which is perpendicular to the longitudinal axis, with the aid of an advancing unit.

Figure 3:
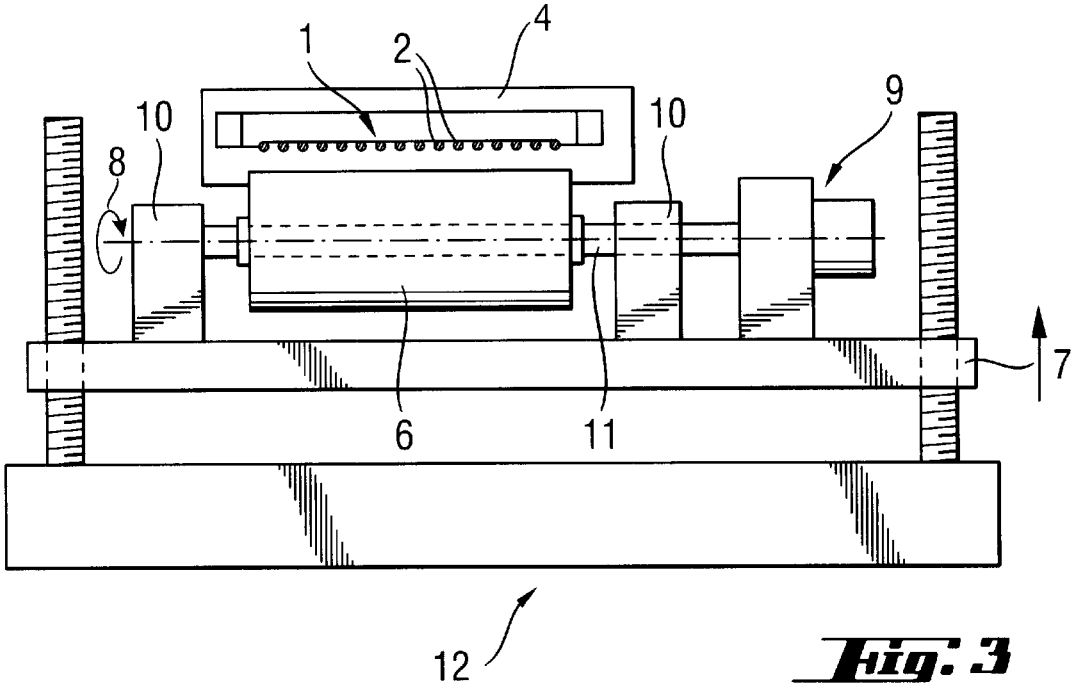
FIG. 3 is a diagrammatic side view of the apparatus of FIG. 1.

FIG. 3 diagrammatically depicts a device according to the invention as shown in FIG. 1, with linear web (1) and saw head (4) and workpiece (6), this figure also diagrammatically depicting a device for rotating (9), holding (10) and tensioning (11) the workpiece (6) and an advancing unit (12) for the workpiece (6). The workpiece (6) extends rotationally symmetrically about its longitudinal axis. By way of example, the center sleeves referred to above are suitable for holding and rotating the workpiece.

As an alternative to the embodiments illustrated in FIGS. 1 to 3, it is also possible for a plurality of workpieces to be sawed in a parallel or series arrangement.

Figure 4:
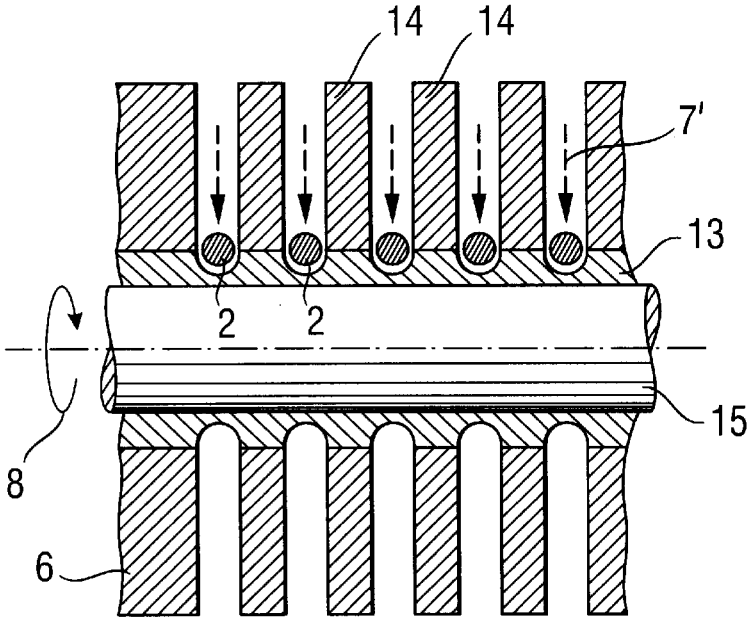
FIG. 4 is a cross-section of a workpiece designed as a hollow cylinder.

FIG. 4 shows a further option with which a workpiece (6) which is designed as a hollow cylinder can be mechanically tensioned with the aid of tensioning mandrels comprising an intermediate layer (13) and a metallic base body (15). As an alternative, the workpiece (6), which is designed as a hollow cylinder, can be cast using a tensioning mandrel with the aid of a suitable curable intermediate compound (13). In both cases, the intermediate layers (13) are such that the saw wires (2) can saw into them when cutting through the workpiece (6) without being damaged and, at the same time, the resultant wafers (14) are securely fixed to the tensioning mandrel (15). (7) indicates the sawing direction of the saw wires (2). The rotation means is preferably designed in such a way that the rotational speed of the workpiece can be set such that the circumferential speed at the parting point is up to 30 m/s.

Figure 5:
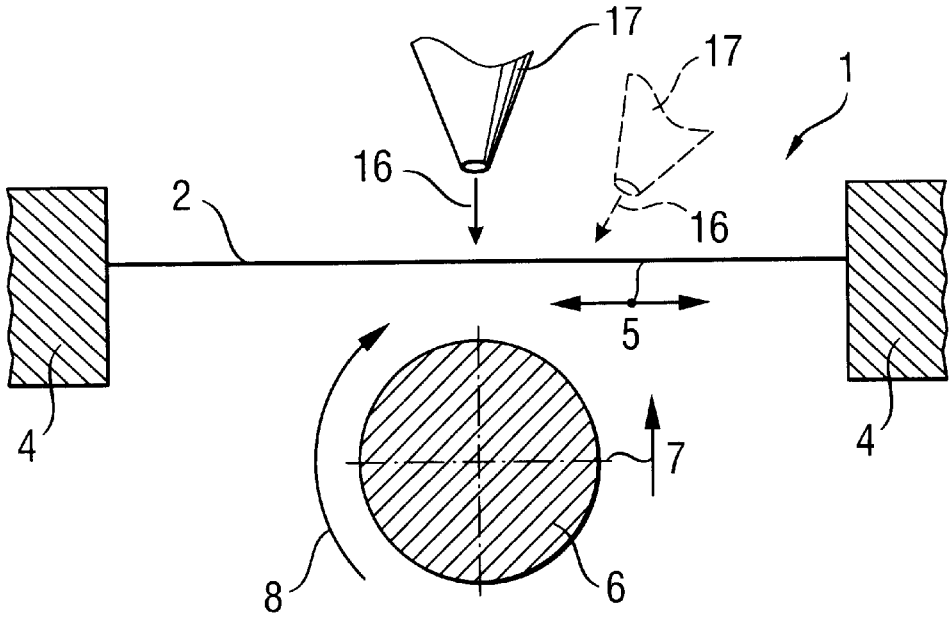
FIG. 5 is a diagrammatic representation of an apparatus arranged for liquid cooling of the workpiece.

FIG. 5 shows a method in which a coolant supply (16) is fed via nozzles (17), preferably parallel to the advancing movement. Alternatively, the coolant supply may be fed obliquely or perpendicularly with respect to the advancing movement.

Figure 6:
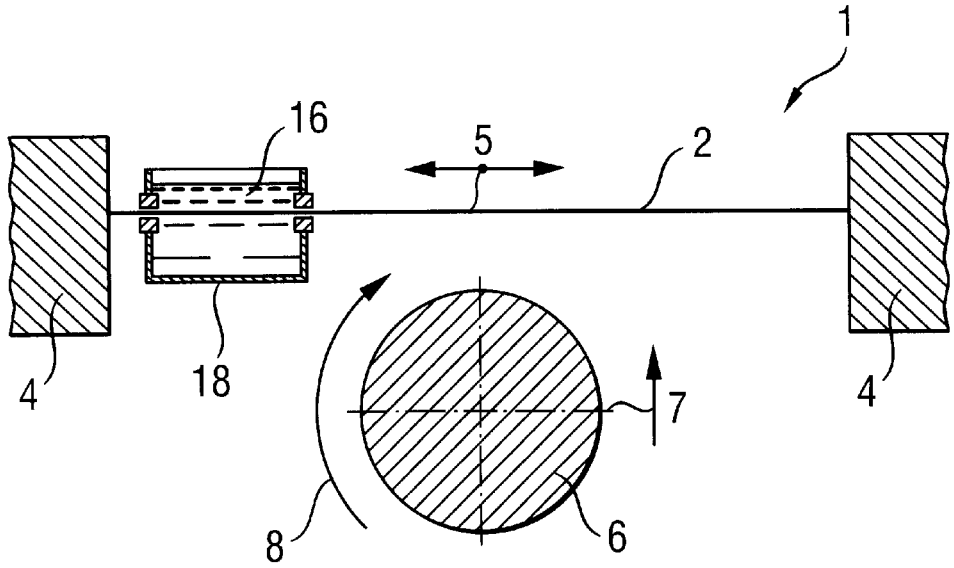
FIG. 6 is a diagrammatic representation of an apparatus arranged for cooling of the saw wire.

FIG. 6 shows an embodiment of the coolant supply in which the saw wire (2) is wetted with liquid (16) as it passes through a basin (18).

Figure 7:
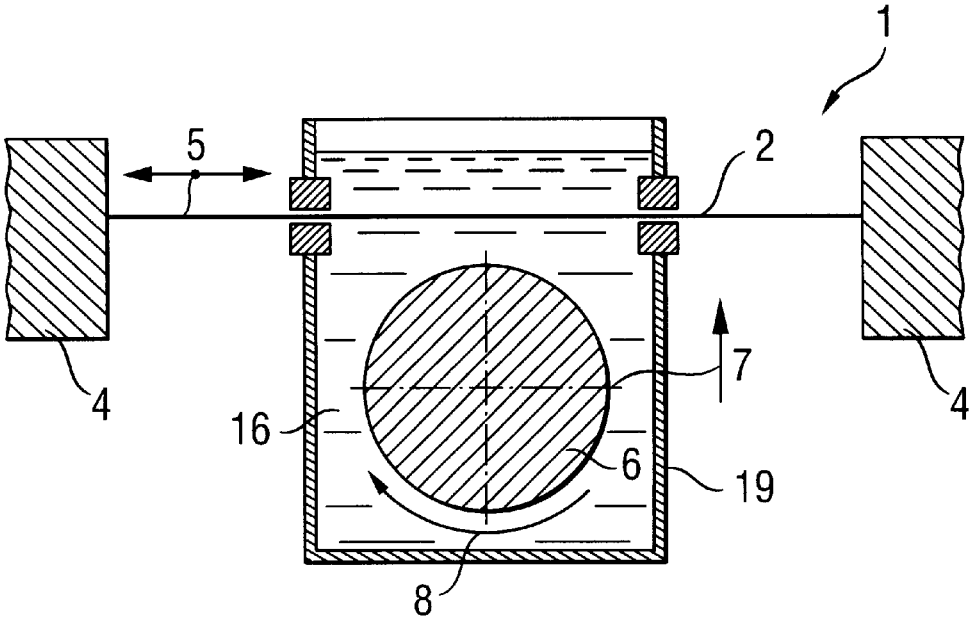
FIG. 7 is a diagrammatic representation of another embodiment of a cooling arrangement.

FIG. 7 shows a variant of the coolant supply in which the entire operation of cutting the material (6) by means of the saw wire (2) is carried out in a trough (19) entirely under coolant.

We claim:

1. A device for simultaneously separating a multiplicity of wafers from a hard brittle workpiece having a longitudinal axis, comprising:

a linear wire web made from saw wire coated with abrasive grain and formed from a multiplicity of individual wires;

an advancing device which brings about a translational relative movement between the workpiece and the wire web of the wire saw, said movement being perpendicular to the longitudinal axis of the workpiece and in the course of which movement the workpiece is passed through the wire web; and a device for holding and rotating the workplace about the longitudinal axis.

2. The device as claimed in one of claim 1, wherein the saw wires used are diamond saw wires.

3. The device of claim 1, wherein the wire web comprises a saw wire coated with abrasive grain.

4. The device of claim 1, wherein the saw wires used are diamond saw wires.

5. The device of claim 1, wherein the saw wires are diamond saw wires.

6. A method for simultaneously separating a multiplicity of wafers from a hard brittle workpiece, wherein the workpiece, which has a longitudinal axis, is passed through the wire web, with the aid of an advancing device, by means of a translational relative movement between the workpiece and the wire web comprising a multiplicity of individual wires, said movement being perpendicular to the longitudinal axis of the workpiece, and wherein the workpiece is divided into wafers as it penetrates through the wire web, the workpiece being rotated about its longitudinal axis as the wafers are being separated.

7. The method as claimed in claim 1, wherein the wafers are separated under the action of a slurry.

8. The method of claim 7, wherein a plurality of workpieces are arranged next to one another and the wafers are separated from the workpieces simultaneously.

9. The method as claimed in claim 6, which is carried out using a coolant.

10. The method of claim 9, wherein a plurality of workpieces are arranged next to one another and the wafers are separated from the workpieces simultaneously.

11. The method as claimed in claim 6, wherein a plurality of workpieces are arranged next to one another and the wafers are separated from the workpieces simultaneously.

12. The method of claim 6, wherein the wafers are separated under the action of a slurry.

13. The method of claim 6, which is carried out using a coolant.

14. The method of claim 6, wherein a plurality of workpieces are arrange next to one another and the wafers are separated from the workpieces simultaneously.

* * * * *